US010323642B2

(12) United States Patent
Weiske

(10) Patent No.: US 10,323,642 B2
(45) Date of Patent: Jun. 18, 2019

(54) PUMP MOTOR WITH A FIXED BEARING

(71) Applicant: Bühler Motor GmbH, Nürnberg (DE)

(72) Inventor: Klaus Weiske, Schwaig (DE)

(73) Assignee: BÜHLER MOTOR GMBH, Nürnberg (DE)

( * ) Notice: Subject to any disclaimer, the term of this patent is extended or adjusted under 35 U.S.C. 154(b) by 115 days.

(21) Appl. No.: 15/483,060

(22) Filed: Apr. 10, 2017

(65) Prior Publication Data

US 2017/0298946 A1 Oct. 19, 2017

(30) Foreign Application Priority Data

Apr. 15, 2016 (DE) ..... 10 2016 206 405

(51) Int. Cl.

| | |
|---|---|
| ***F04D 13/06*** | (2006.01) |
| ***F04D 13/02*** | (2006.01) |
| ***F04D 29/046*** | (2006.01) |
| ***F04D 29/041*** | (2006.01) |
| ***F04D 1/00*** | (2006.01) |
| ***F04D 29/043*** | (2006.01) |
| ***F04D 29/22*** | (2006.01) |
| ***F04D 29/42*** | (2006.01) |

(52) U.S. Cl.

CPC ..... *F04D 13/0633* (2013.01); *F04D 1/00* (2013.01); *F04D 13/026* (2013.01); *F04D 13/06* (2013.01); *F04D 29/041* (2013.01); *F04D 29/043* (2013.01); *F04D 29/046* (2013.01); *F04D 29/22* (2013.01); *F04D 29/426* (2013.01); *F05D 2230/22* (2013.01); *F05D 2260/37* (2013.01)

(58) Field of Classification Search

CPC ..... F04D 13/026; F04D 13/0606; F04D 13/0633; F04D 29/04; F04D 29/041; F04D 29/046; F04D 29/0467

See application file for complete search history.

(56) References Cited

U.S. PATENT DOCUMENTS

| | | | | |
|---|---|---|---|---|
| 6,082,974 A * | 7/2000 | Takemoto | ..... | F04D 15/0066 417/366 |
| 6,604,917 B2 * | 8/2003 | Casper | ..... | F04D 13/0606 417/420 |
| 2014/0072459 A1 | 3/2014 | Kalaysky | | |

FOREIGN PATENT DOCUMENTS

| | | |
|---|---|---|
| DE | 676 174 C | 5/1939 |
| DE | 10 2011 079 226 A1 | 1/2013 |
| DE | 10 2011 079 226 B4 | 12/2014 |
| FR | 1059088 A | 3/1954 |

* cited by examiner

*Primary Examiner* — Peter J Bertheaud

(74) *Attorney, Agent, or Firm* — Westerman, Hattori, Daniels & Adrian

(57) ABSTRACT

A pump motor having a permanent magnet rotor, a containment shell, a wound stator, a motor housing, a pump head, a shaft, which is secured in the containment shell on the one hand and in the pump head on the other hand, and a fixed bearing, which is pressed or injected into the permanent magnet rotor and rotatably mounts it on the shaft. The pump motor provides a reliable and economically producible bearing of the permanent magnet rotor on the shaft in a generic pump motor, in which the bearing abutting uniformly against the shaft over the entire bearing length and during a complete rotation can be achieved, small angle errors can be compensated, and noises can be reduced.

14 Claims, 2 Drawing Sheets

PUMP MOTOR WITH A FIXED BEARING

BACKGROUND OF THE INVENTION (1) Field of the Invention

The present invention relates to a pump motor and its internal construction. The pump motor has a permanent magnet rotor, a containment shell, a wound stator, a motor housing, a pump head, and a shaft, which is secured in the containment shell on the one hand and in the pump head on the other hand, and a fixed bearing, which is pressed or injected into the permanent magnet rotor and rotatably mounts it on the shaft.

(2) Description of Related Art Including Information Disclosed Under 37 CFR 197 and 1.98

In combustion engines of motor vehicles, mechanical pumps driven by the crankshaft via a gear belt are generally provided as main cooling water pump. As a support or an alternative in a shut-off combustion engine, electric ancillary cooling water pumps are used, which are generally designed as electronically commutated direct-current motors. Main cooling water pumps can also be operated electrically. From DE 10 2011 079 226 B4 is known a generic pump, in which bearing bushes are used to mount the permanent magnet rotor on the shaft. In doing so, a running surface of the bearing can be deformed by a press-fitting process of the bearing bush into the permanent magnet rotor such that punctual or linear contacts of the bush with the shaft result. This effect is particularly pronounced in bearing bushes with different material thicknesses, as is the case in collar bushes. Such deformations generally result in increased bearing noises. For economic reasons, the tolerances for bearing bushes cannot be arbitrarily small, which is why undefined bearing pairings can occur, in which the shaft abuts non-uniformly over the bearing length and non-uniformities also occur during a rotation.

SUMMARY OF THE INVENTION

The task of the present invention is therefore to provide for a reliable and economically producible bearing of the permanent magnet rotor on the shaft in a generic pump motor, in which the bearing abutting uniformly against the shaft over the entire bearing length and during a complete rotation can be achieved, small angle errors can be compensated, and noises can be reduced.

According to the invention, the bearing consists of a press ring pressed into the permanent magnet rotor, a thrust ring accommodated rotatably on the shaft, and a ring disk-shaped hub. This results in a function separation of the individual bearing components. The press ring can and may deform slightly during the press-fitting process, the thrust ring retains its optimum shape for the running properties, and the ring disk-shaped hub constitutes the connecting element between the press ring and the thrust ring. The hub can deform slightly in a region close to the press ring but retains its shape in a region close to the thrust ring and does not transfer any deformation forces onto the thrust ring.

The fixed bearing can be particularly economically produced because the press ring, the thrust ring, and the hub form an integral component. In order to protect the thrust ring against deformations, it is advantageous to design the hub to be resilient so that its stiffness is not sufficient to transfer the press-fitting forces to the thrust ring. In order to ensure the resilience of the hub, the fixed bearing comprises an H-shaped or U-shaped ring cross section. The thickness of the disk-shaped hub can be selected according to the requirements.

In order to ensure good sliding properties even during axial force application, a thrust washer can be provided, which is accommodated on the shaft between the fixed bearing and the bearing accommodation sleeve. The thrust ring of the fixed bearing is located axially opposite the bearing accommodation sleeve or, if applicable, the thrust washer.

The fixed bearing is arranged between a hollow shaft and a bearing accommodation sleeve. When axial forces occur, the hub can act in a dampening manner as a result of its resilience since the press ring is radially offset to the thrust ring and only the press ring abuts against the hollow shaft. The fixed bearing is generally mounted up to the hollow shaft. The thrust ring is located freely opposite the hollow shaft.

The fixed bearing is preferably arranged radially between a permanent magnet and the shaft. In doing so, the fixed bearing is directly pressed into the permanent magnet.

The permanent magnet itself is connected in a form-fitted matter to the hollow shaft. The permanent magnet preferably consists of a plastic bonded rare-earth magnet, which is master molded directly on the hollow shaft. The form fit is established by a groove on the outer circumference of the hollow shaft or by recesses suitably formed in another manner.

The hollow shaft is connected to a pump impeller or integrally master molded with it. The impeller comprises pump vanes and can comprise a cover plate to improve efficiency.

In the region of the pump impeller, the hollow shaft comprises a spherical slide bearing, which interacts with a spherical counter bearing, which is held in a seat in the pump head. During operation, the spherical bearing surfaces function in such a way that self-centering takes place so that the bearing pairing assumes both an axial bearing function and a radial bearing function. This bearing type significantly improves the running smoothness.

It is suggested to construct the fixed bearing according to the invention from one bearing material. This can be a plastic interspersed with carbon fibers, a graphite material, a sintered metal, or something else.

DESCRIPTION OF THE SEVERAL VIEWS OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE INVENTION

Figure 1:
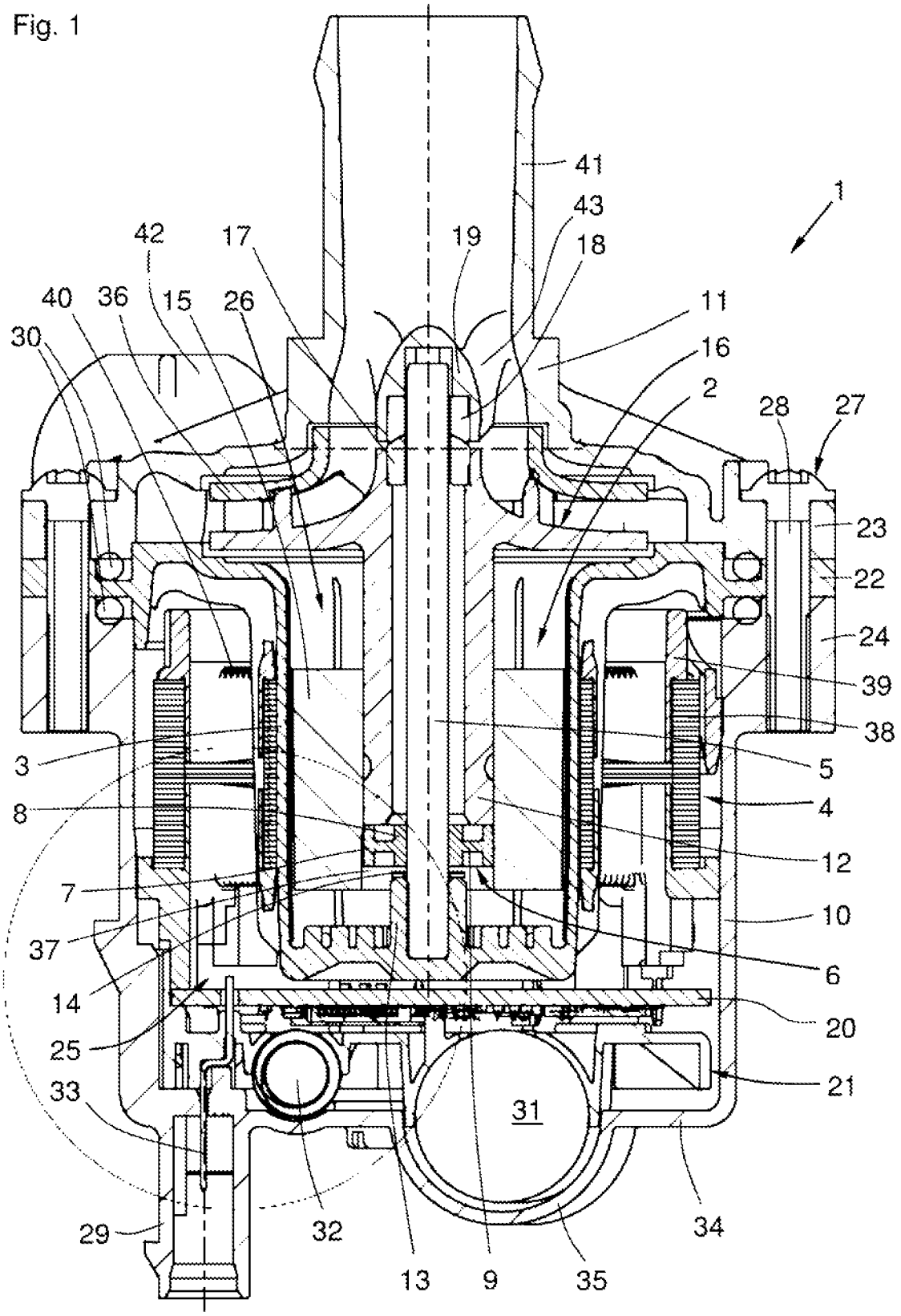
FIG. 1 is a sectional view of a pump motor according to the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

FIG. 1 shows a sectional view of a pump motor 1 according to the invention, having a wound stator 4, a permanent magnet rotor 2, a containment shell 3, a pump head 11, a circuit board 20, a support plate 21, and a motor housing 10. The stator 4, the circuit board 20, and the support plate 21 are located in a dry chamber 25. The permanent magnet rotor 2 is rotatably mounted in a wet chamber 26 around a shaft 5, which is secured on the one hand in the containment shell 3 and on the other hand in the pump head 11.

The containment shell 3 comprises a containment shell flange 22, and the pump head 11 comprises a pump head flange 23. The motor housing 10 is designed to be pot-like and comprises a housing flange 24 and a connector shaft 29. The pump head flange 23, the containment shell flange 22, and the housing flange 24 comprise screw eyes 27 with screws 28, by means of which the pump head 11 and the containment shell 3 are screwed to the motor housing 10. On both sides of the containment shell flange 22, O-rings 30 are arranged as sealing elements. The circuit board 20 is populated with a plurality of SMD components.

Larger components, such as an electrolytic capacitor 31 and a choke coil 32, are mechanically held on the support plate 21 but electrically connected on the circuit board 20. The circuit board 20 and the support plate 21 are axially secured between the stator 4 and the motor housing 10. The circuit board 20 is axially and radially secured between the stator 4 and the support plate 21. In the support plate 21, a contact element 33 is mechanically mounted, which is also electrically connected to the circuit board 20. A bottom 34 of the pot-like motor housing 10 comprises an indentation 35, which is adapted to the shape of the electrolytic capacitor 31.

Illustrated furthermore is a pump impeller 16, which is integral with a hollow shaft 12. The pump impeller 16 comprises a cover plate 36. The permanent magnet rotor 2 with the pump impeller 16 is rotatably mounted via a fixed bearing 6 and a spherical bearing 17 on the shaft 5 and between the pump head 11 and the containment shell 3. The fixed bearing 6 is arranged between a hollow cylindrical permanent magnet 15 injected around the hollow shaft 12 and consisting of a plastic bonded material and the shaft 5. The fixed bearing 6 mounts the pump impeller 2 radially as well as axially via the end of the hollow shaft 12 and a thrust washer 14, which abuts against a bearing accommodation sleeve 13 integral with the containment shell 3. The fixed bearing 6 comprises a press ring 7, a thrust ring 8, and a disk-shaped hub 9. The thickness of the hub 9 is selected such that a radial deformation force, which acts on the hub 9 during a press-fitting process of the fixed bearing 6 into a central hollow space 37 of the permanent magnet 15, is not transferred as far as the thrust ring 8 but brings about a deformation of the hub 9. The hollow cylindrical shape of the thrust ring 8 is for the most part retained. FIG. 1 furthermore shows a stator sheet package 38, insulating elements 39, and a stator winding 40. The pump head 11 comprises a suction nozzle 41 and a discharge nozzle 42. Spokes 43 in the suction nozzle 41 constitute a permeable connection between the suction nozzle 41 and the seat 19.

Figure 2:
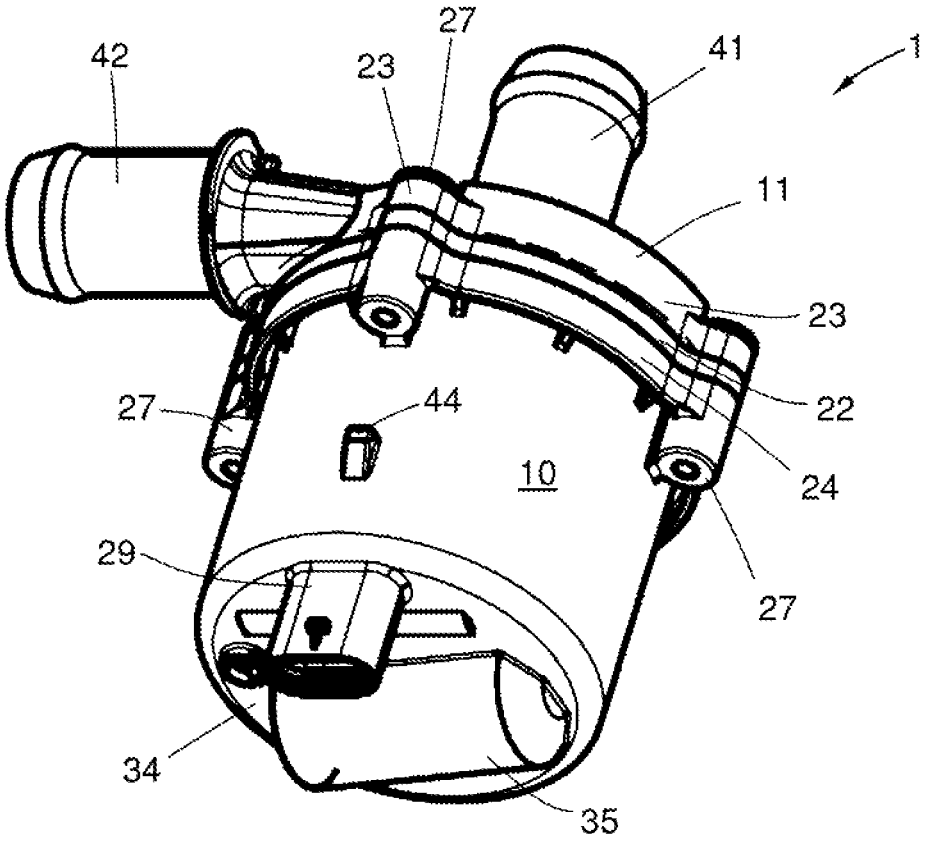
FIG. 2 a spatial representation of the pump motor.

FIG. 2 shows a spatial representation of a pump motor 1, with the pump head 11 with suction nozzle 41 and discharge nozzle 42 and a pump head flange 23, a containment shell flange 22 integral with the containment shell, the motor housing 10 with the housing flange 24, the bottom 34, the connector shaft 29, and the indentation 35 for accommodating an electrolytic capacitor. Screw eyes 27 can also be seen, which are formed as extensions in the pump head flange 23, the containment shell flange 22, and the housing flange 24 and allow for a screw connection. On the motor housing 10 is formed an axial securing device 44, which serves to axially secure an annular mounting device positioned around the motor housing 10.

It is to be understood that the present invention is not limited to the illustrated embodiments described herein. Various types and styles of user interfaces may be used in accordance with the present invention without limitation. Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

LIST OF REFERENCE SYMBOLS

| | |
|---|---|
| 1 | Pump motor |
| 2 | Permanent magnet rotor |
| 3 | Containment shell |
| 4 | Stator |
| 5 | Shaft |
| 6 | Fixed bearing |
| 7 | Press ring |
| 8 | Thrust ring |
| 9 | Hub |
| 10 | Motor housing |
| 11 | Pump head |
| 12 | Hollow shaft |
| 13 | Bearing accommodation sleeve |
| 14 | Thrust washer |
| 15 | Permanent magnet |
| 16 | Pump impeller |
| 17 | Spherical slide bearing |
| 18 | Spherical counter bearing |
| 19 | Seat |
| 20 | Circuit board |
| 21 | Support plate |
| 22 | Containment shell flange |
| 23 | Pump head flange |
| 24 | Housing flange |
| 25 | Dry chamber |
| 26 | Wet chamber |
| 27 | Screw eye |
| 28 | Screw |
| 29 | Connector shaft |
| 30 | O-ring |
| 33 | Contact element |
| 34 | Bottom |
| 35 | Indentation |
| 36 | Cover plate |
| 37 | Hollow space |
| 38 | Stator sheet package |
| 39 | Insulating element |
| 40 | Stator winding |
| 41 | Suction nozzle |
| 42 | Discharge nozzle |
| 43 | Spoke |
| 44 | Axial securing device |

What is claimed is:

1. A pump motor comprising:

a permanent magnet rotor;

a containment shell;

a wound stator;

a motor housing;

a pump head;

an elongated shaft having one end secured in the containment shell and the other end secured in the pump head;

a fixed bearing, which is pressed into the permanent magnet rotor and rotatably mounts the permanent magnet rotor on the elongated shaft, the fixed bearing including a press ring fitted into the permanent magnet rotor, a thrust ring accommodated rotatably on the shaft, and a ring disk-shaped hub;

a hollow shaft; and a bearing accommodation sleeve, wherein the fixed bearing is arranged axially between the hollow shaft and the bearing accommodation sleeve, and wherein the fixed bearing comprises an H-shaped or U-shaped ring cross section.

2. The pump motor according to claim 1, wherein, the press ring, the thrust ring, and the hub are integral.

3. The pump motor according to claim 1, wherein the hub is resilient.

4. The pump motor according to claim 1, further comprising a thrust washer accommodated on the shaft between the fixed bearing and the bearing accommodation sleeve.

5. The pump motor according to claim 1, further comprising a thrust washer, wherein the thrust ring of the fixed bearing is located axially opposite the bearing accommodation sleeve or the thrust washer.

6. The pump motor according to claim 1, wherein the press ring is axially opposite the hollow shaft.

7. The pump motor according to claim 6, wherein the press ring axially abuts the hollow shaft.

8. The pump motor according to claim 1, further comprising a permanent magnet, wherein the fixed bearing is arranged radially between the shaft and the permanent magnet.

9. The pump motor according to claim 8, wherein the hollow shaft is connected in a form-fitted manner to the permanent magnet.

10. The pump motor according to claim 9, further comprising a pump impeller, wherein the hollow shaft is connected to the pump impeller.

11. The pump motor according to claim 10, wherein the hollow shaft comprises a spherical slide bearing in the region of the pump impeller, and wherein the spherical slide bearing interacts with a spherical counter bearing that is held in a seat in the pump head.

12. The pump motor according to claim 1, wherein the fixed bearing consists of a sintered metal.

13. The pump motor according to claim 1, wherein the pump head is removably attached to the pump housing via screws.

14. The pump motor according to claim 1, wherein the fixed bearing is mounted directly on the elongated shaft.

* * * * *